US007445038B2

(12) United States Patent
Liu et al.

(10) Patent No.: US 7,445,038 B2
(45) Date of Patent: Nov. 4, 2008

(54) ROTARY TOTAL HEAT EXCHANGE APPARATUS

(75) Inventors: Tay-Jian Liu, Guangdong (CN); Ming-Chun Lee, Guangdong (CN); Lien-Jin Chiang, Guangdong (CN); Shu-Cheng Yang, Guangdong (CN)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 470 days.

(21) Appl. No.: 11/163,478

(22) Filed: Oct. 20, 2005

(65) Prior Publication Data

US 2006/0213636 A1 Sep. 28, 2006

(30) Foreign Application Priority Data

Mar. 26, 2005 (CN) ..... 2005 1 0033843

(51) Int. Cl.
*F23L 15/02* (2006.01)
*F24H 3/02* (2006.01)

(52) U.S. Cl. ..... 165/8; 165/9; 165/54

(58) Field of Classification Search ..... 165/8, 165/9, 54

See application file for complete search history.

(56) References Cited

U.S. PATENT DOCUMENTS 2,792,071 A * 5/1957 Pennington ..... 96/118
3,991,819 A * 11/1976 Clark ..... 165/59
4,093,435 A 6/1978 Marron et al.
4,114,680 A * 9/1978 Kritzler et al. ..... 165/4
4,188,993 A * 2/1980 Heyn et al. ..... 165/8
4,574,872 A 3/1986 Yano et al.
4,669,531 A * 6/1987 Conde ..... 165/4
4,711,293 A * 12/1987 Niwa et al. ..... 165/4
4,924,934 A * 5/1990 Steele ..... 165/8
4,952,283 A * 8/1990 Besik ..... 165/4
5,002,118 A * 3/1991 Olmstead et al. ..... 165/54
5,372,182 A * 12/1994 Gore ..... 165/7
5,826,641 A * 10/1998 Bierwirth et al. ..... 165/48.1
6,209,622 B1 * 4/2001 Lagace et al. ..... 165/8
7,104,082 B1 * 9/2006 Moratalla ..... 62/271
2001/0013404 A1 * 8/2001 Lagace et al. ..... 165/8
2006/0137852 A1 * 6/2006 Liu et al. ..... 165/8

* cited by examiner

*Primary Examiner*—Cheryl J Tyler
*Assistant Examiner*—Brandon M Rosati
(74) *Attorney, Agent, or Firm*—Winston Hsu

(57) ABSTRACT

A rotary total heat exchange apparatus (30) includes at least an air-providing member (3301), a first air passage and a second air passage, and a total heat exchange wheel (3311). The air-providing member provides a first airflow from outdoors and a second airflow from indoors into the rotary total heat exchange apparatus. The first and second air passages isolate from each other for guiding the first and second airflows respectively passing through the heat exchange wheel. The total heat exchange wheel faces to the first and second airflows provided by the air-providing member, and is capable of rotating through the first and second air passages for conducting a total heat exchange between the first and second airflows.

15 Claims, 7 Drawing Sheets

ROTARY TOTAL HEAT EXCHANGE APPARATUS

FIELD OF THE INVENTION

The present invention relates generally to a heat exchange apparatus, and more particularly to a rotary total heat exchange apparatus which may suitably be applied to a ventilation system for exchanging sensible and latent heat between airflows having different temperatures and humidities.

DESCRIPTION OF RELATED ART

In our daily life, ventilation systems such as air-conditioners are commonly provided in working or living spaces, e.g., office buildings and apartments, for supplying fresh outdoor air and exhausting polluted indoor air simultaneously in order for keeping a favorable and healthy environment where we stay. Generally, the outdoor air and the indoor air have different temperatures and humidities. In this connection, a significant effect of energy saving could be expected if the exchange between the indoor and outdoor airflows can be achieved not only in heat but also in moisture. In order to satisfy such requirements, total heat exchange apparatuses, which can exchange sensible heat (temperature) and latent heat (moisture) simultaneously without mixing up different types of air, are accordingly developed. Total heat exchange apparatuses are effective in energy saving as they can recover both sensible energy (temperature) and latent energy (moisture) between polluted indoor air and fresh outdoor air.

Referring to FIG. 7, a rotary total heat exchanger for conducting total heat exchange between the indoor air and the outdoor air is shown. The heat exchanger includes a rotary wheel 1 defining a plurality of mini air channels 2 therein, for increasing heat conduct areas thereof. The wheel 1 is covered with heat exchange materials having better heat conductivity and moisture permeability for increasing the heat exchange rate of the wheel 1. The wheel 1 is divided by a plate 5 into two portions separately positioned in an air-outlet housing 3 and an air-inlet housing 4. The wheel 1 is driven to rotate through the air-outlet and air-inlet housings 3, 4 by a driving motor 6, to perform heat exchange between the outdoor and indoor airflows. The indoor and outdoor airflows pass through the air channels 2 of the wheel 1 in a counter flow manner. With the rotation of the wheel 1 through the air-outlet and air-inlet housings 3, 4, the indoor and outdoor airflows frequently exchange heat and moisture to ensure that the outdoor fresh air entering into the room has a needed temperature and moisture for satisfying the requirement of the indoor air quality.

Total heat exchange apparatuses are effective in keeping indoor air quality, as well as in energy saving, as is identified above. However, in order to exhibit its full advantages, many improvements still can be made on the design of a total heat exchange apparatus. For example, as far as a rotary total heat exchange apparatus is concerned, the exchange of heat and moisture between different airflows is conducted only in its rotary wheel 1 by resorting to the heat-conductivity and moisture-permeability capabilities of the heat exchange materials of the wheel 1, which results in a limited sensible heat exchange rate as the materials typically have its focus placed on the capability of moisture-permeability rather than heat-conductivity.

Moreover, the supplied air and the exhausted air to be heat-exchanged are typically directed by blowers. The airflows provided by the blowers flow in a direction which does not enable the airflows to flow evenly over mini channels 2 of the wheel 1 in the total heat exchange apparatus. This greatly impairs the total heat exchange efficiency of heat and moisture between the supplied air and the exhausted air.

In view of the above-mentioned problems of the total heat exchange apparatus, there is a need for a total heat exchange apparatus which can improve the sensible heat exchange effect between different airflows conducting heat exchange in the total heat exchange apparatus to increase the indoor air quality.

SUMMARY OF INVENTION

The present invention relates to a rotary total heat exchange apparatus for being typically used in a ventilation system such as an air conditioner. According to an embodiment of the present invention, the rotary total heat exchange apparatus includes at least an air blower, a first air passage and a second air passage, and a total heat exchange wheel. The air blower provides a first airflow from outdoors and a second airflow from indoors into the rotary total heat exchange apparatus. The first and second air passages isolate from each other for guiding the first and second airflows respectively passing through the total heat exchange wheel. The total heat exchange wheel faces to the first and second airflows provided by the air blower, and is capable of rotating through the first and second air passages for conducting a total heat exchange therebetween. After flowing through the wheel, the first and second airflows flow respectively into first and second sub-regions. The first and second sub-regions are hermetically separated by an air spacing member. The air spacing member includes a first spacing plate, a pair of second spacing plates extending from a front side of the first spacing plate to connect respectively with top and bottom edges of a partition plate in which the wheel is mounted, and a third spacing plate connecting with two adjacent sides of the second spacing plates and dividing the wheel into two halves.

Other advantages and novel features of the present invention will become more apparent from the following detailed description of preferred embodiments when taken in conjunction with the accompanying drawings, in which:

DETAILED DESCRIPTION

Figure 1:
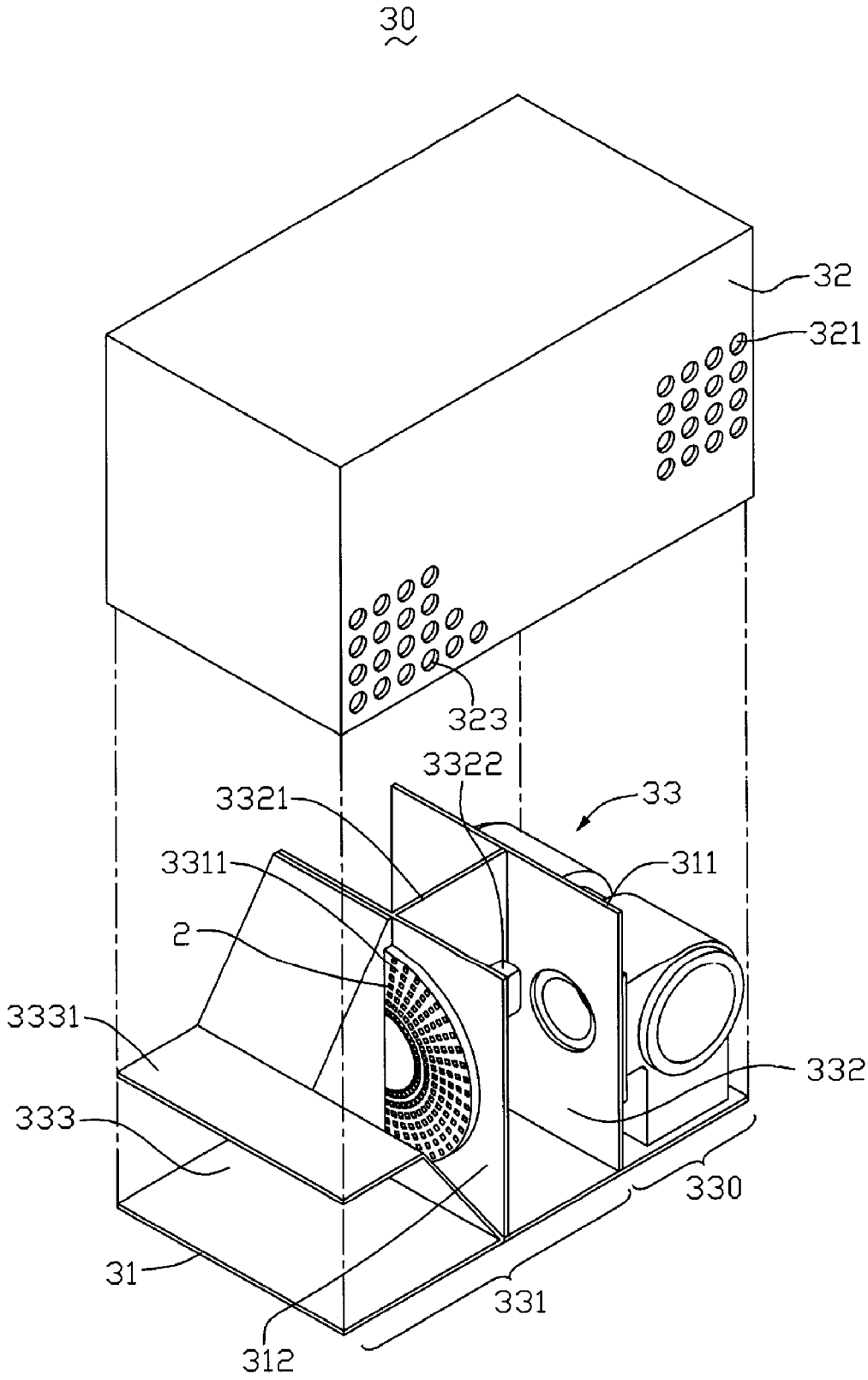
FIG. 1 is an exploded, isometric view of a rotary total heat exchange apparatus in accordance with a preferred embodiment of the present invention.
Figure 2:
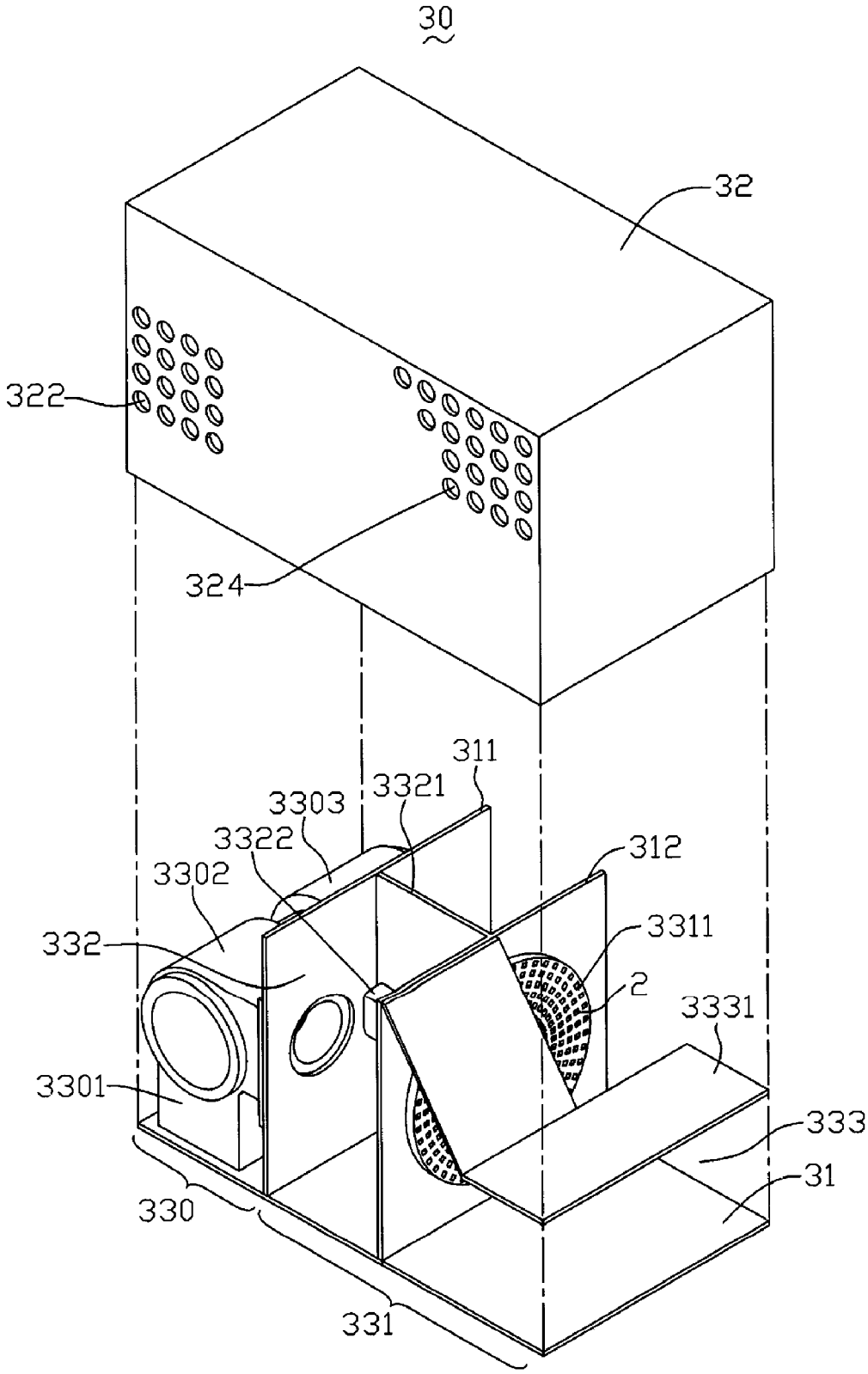
FIG. 2 is similar to FIG. 1, but viewed from another aspect.

FIGS. 1 and 2 show a rotary total heat exchange apparatus 30 in accordance with a preferred embodiment of the present invention, for exchanging sensible and latent heat between outdoor and indoor airflows having different temperatures and humidities. The rotary total heat exchange apparatus 30 includes a chassis 31, a variety of components attached to the chassis 31, and a cover 32 cooperated with the chassis 31 to form a system enclosure 33 for enclosing the various components therein. A pair of opposite sidewalls of the cover 32 defines two air inlet openings 321, 322 and two air outlet openings 323, 324 therein corresponding to the outdoor and indoor airflows. The outdoor airflow flows into the apparatus 30 via the inlet opening 322, and leaves the apparatus 30 via the outlet opening 323. The indoor airflow flows into the apparatus 30 via the inlet opening 321 and leaves it via the outlet opening 324. The rotary total heat exchange apparatus 30 further includes a first partition plate 311 perpendicular to the chassis 31, to divide an interior of the system enclosure 33 into an air-providing housing 330, and a total heat exchange housing 331, with each housing containing specific components therein. The rotary total heat exchange apparatus 30 defines a first and a second air passages in the interior of the system enclosure 33, for guiding the outdoor and indoor airflows passing through the air-providing housing 330 and the total heat exchange housing 331.

The air-providing housing 330 contains therein an air-providing member such as a blower 3301 with a pair of impellers (not visible) for supplying the outdoor and indoor airflows. The blower 3301 includes two air-guiding ducts 3302, 3303 corresponding to the two air inlet openings 322, 321 respectively, for guiding the provided outdoor and indoor airflows entering into the total heat exchange housing 331 from the air-providing housing 330.

The total heat exchange housing 331 is divided into a first housing 332 and a second housing 333 via a second partition plate 312. The second partition plate 312 defines an opening (not labeled) at a middle portion thereof, for hermetically receiving a rotary wheel 3311 defining a plurality of beehive-like air channels 2 therein. The second partition plate 312 is positioned parallel to the first partition plate 311, making the air channels 2 of the rotary wheel 3311 directly face to outlets of the air-guiding ducts 3302, 3303.

The first housing 332 includes a dividing member 3321 at a middle portion thereof. The dividing member 3321 is positioned perpendicular to and hermetically connected with the first and second partition plates 311, 312, to divide the first housing 332 into a left housing (not labeled) and a right housing (not labeled) respectively correspondent to the outdoor and indoor airflows. The first housing 332 also includes a driving motor 3322 mounted on the dividing member 3321, for driving the rotary wheel 3311 to rotate across the left and right housings to conduct total heat exchange between the indoor and outdoor airflows.

Figure 3:
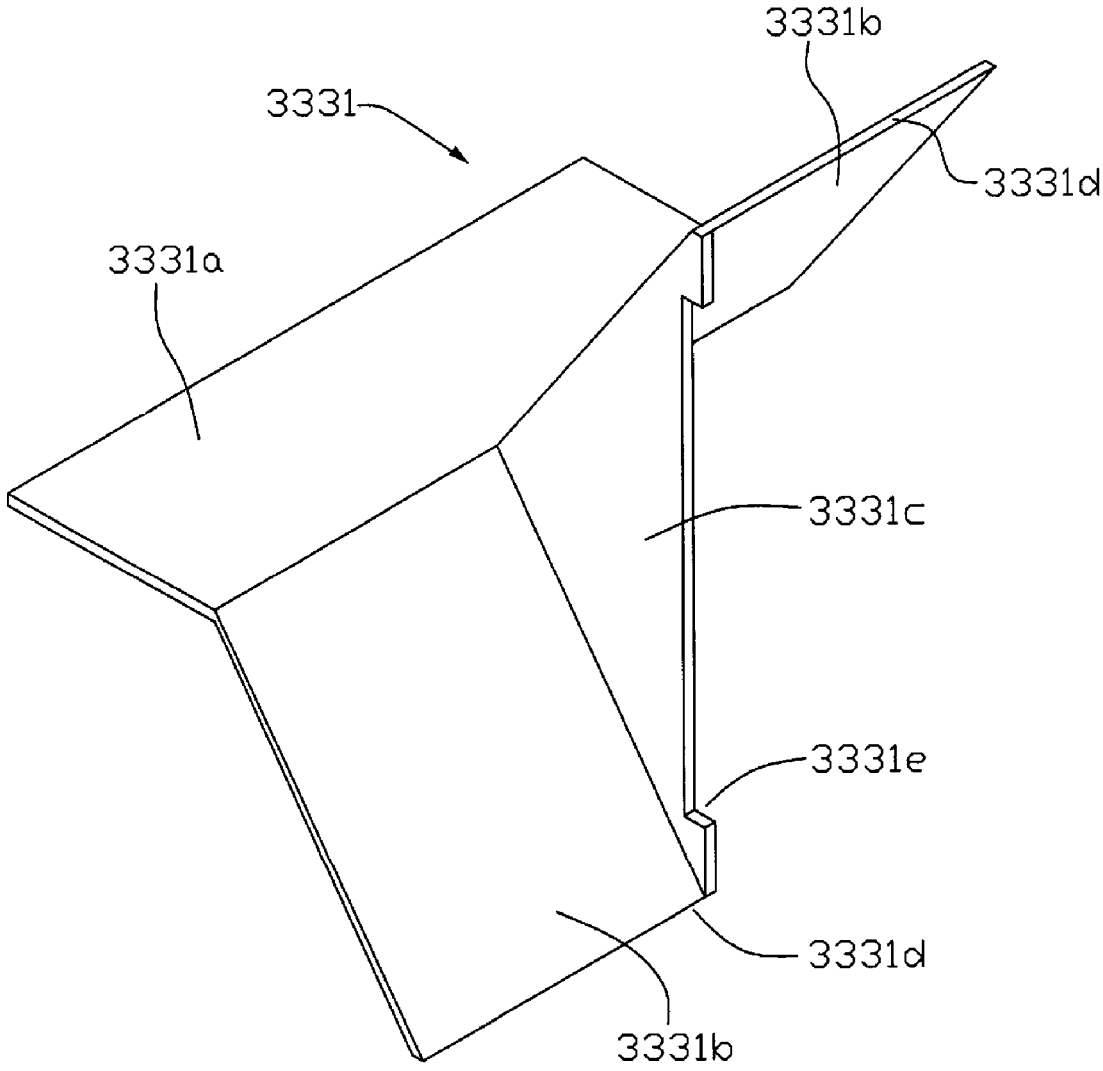
FIG. 3 is an isometric view of a spacing plate of the rotary total heat exchange apparatus shown in FIGS. 1 and 2.

Referring to FIG. 3, an air spacing member 3331 is received in the second housing 333. The air spacing member 3331 includes a horizontal first spacing plate 3331*a*, two second spacing plates 3331*b* extending slantingly and upwardly/downwardly from a common side of the first spacing plate 3331*a*, and a third spacing plate 3331*c* located between and vertically connecting with neighboring sides of the second spacing plates 3331*b*. The third spacing plate 3331*c* also connects with the horizontal first spacing plate 3331*a*. The air spacing member 3331 divides the second housing 333 into two separate upper and lower housings communicating with the right and left housings of the first housing 332, respectively, through the rotary wheel 3311, to guide the indoor airflow leaving a room via the air outlet opening 324 of the cover 32, and the outdoor air entering the room via the air outlet opening 323 of the cover 32.

In the illustrated embodiment of the present invention, the supplied outdoor air and the exhausted indoor air supplied by the blower 3301 are directed to the first housing 332 of the total heat exchange housing 331 by the air-guiding ducts 3302, 3303. After being buffered in two separated spaces defined by the first housing 332, the two airflows pass through the rotary wheel 3311 to conduct total heat exchange therebetween. Then, the supplied and exhausted airflows enter into the second housing 333. The air spacing member 3331 in the second housing 333 finally guides the outdoor fresh air supplied into indoors, and the indoor dirty air exhausted to outdoors. In this embodiment, a better total heat exchange between the supplied air and the exhausted air is obtained by the rotary wheel 3311. Also in this embodiment, the air channels 2 of rotary wheel 3311 are directly facing to outlets of the air-guiding ducts 3302, 3303. This makes airflows enter into the first housing 332 and flow to the rotary wheel 3311 directly, thereby resulting that the airflows are more evenly distributed over the air channels 2 of the rotary wheel 3311. Furthermore, by the design of the air spacing member 3331, the second housing 333 can have a reduced length. Thus, a compact total heat exchange apparatus 30 can be achieved. The air spacing member 3331 is mounted in the second housing 333 in such a manner that the second spacing plates 3331*b* have front free edges 3331*d* (shown in FIG. 3) extending from the first spacing plate 3331*a* hermetically connected to top and bottom ends of the second partition plate 312, respectively. In the meanwhile, a front free edge of the third spacing plate 3331*c* has a cutout 3331*e* (shown in FIG. 3) which is vertically connected to a middle of the second partition plate 312. The cutout 3331*e* accommodates a middle of the rotary wheel 3311 therein. The rear and side edges of the first spacing plate 3331*a* and the opposite side edges of the second spacing plates 3331*b* are hermetically connected to the inner sides of the cover 32, respectively.

Figure 4:
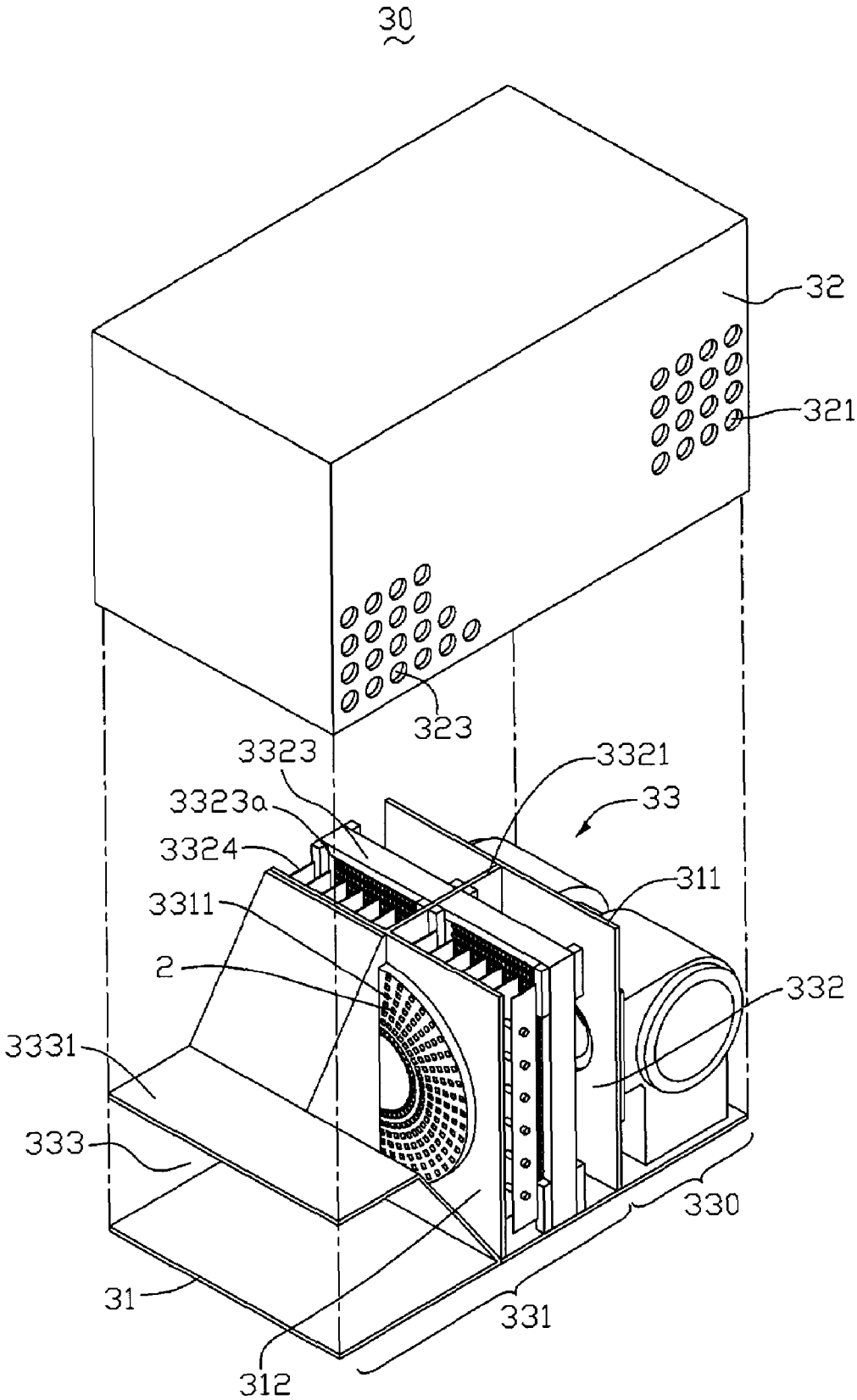
FIG. 4 is an exploded, isometric view of a rotary total heat exchange apparatus in accordance with another embodiment of the present invention.
Figure 5:
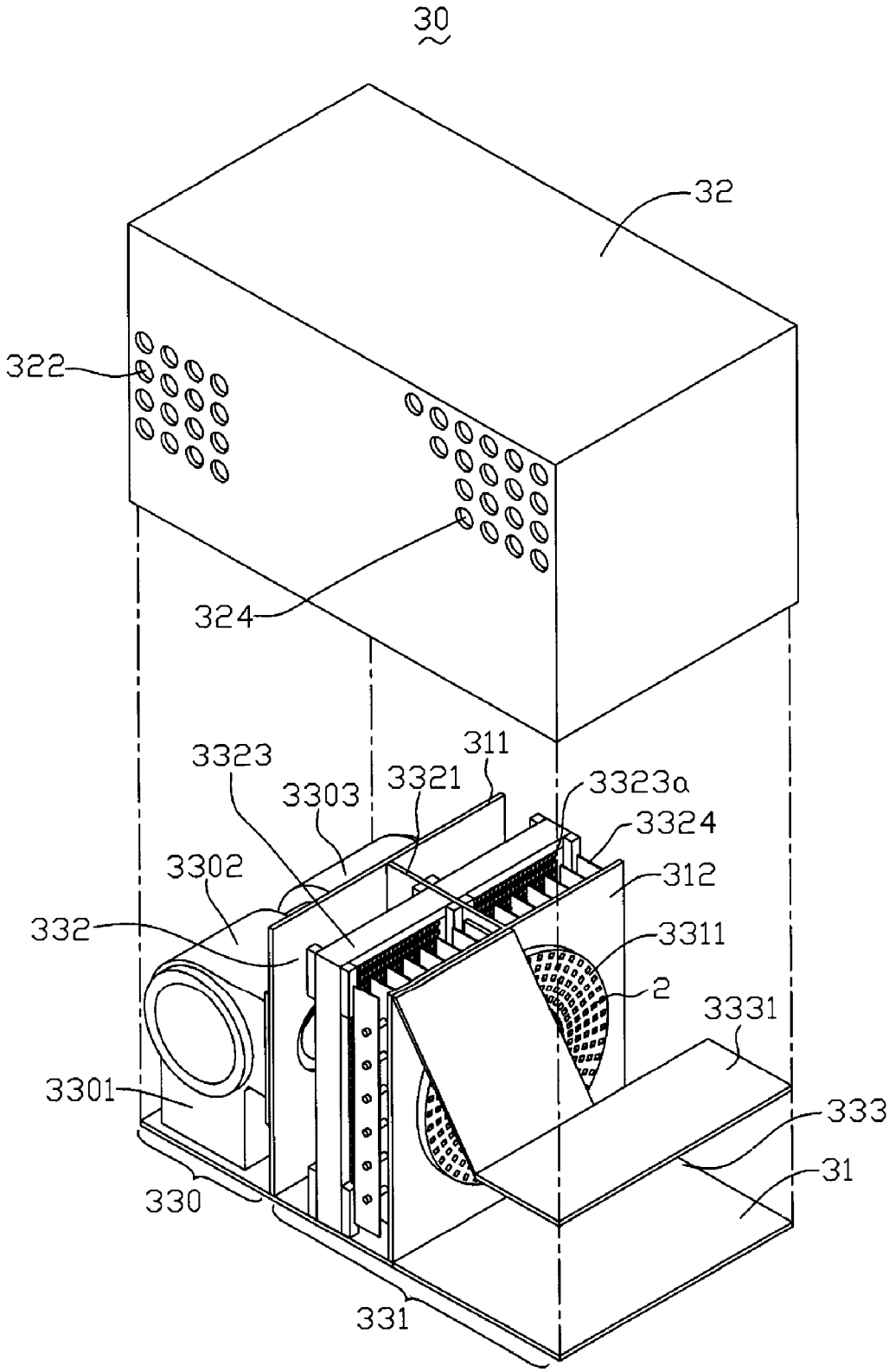
FIG. 5 is similar to FIG. 4, but viewed from another aspect.
Figure 6:
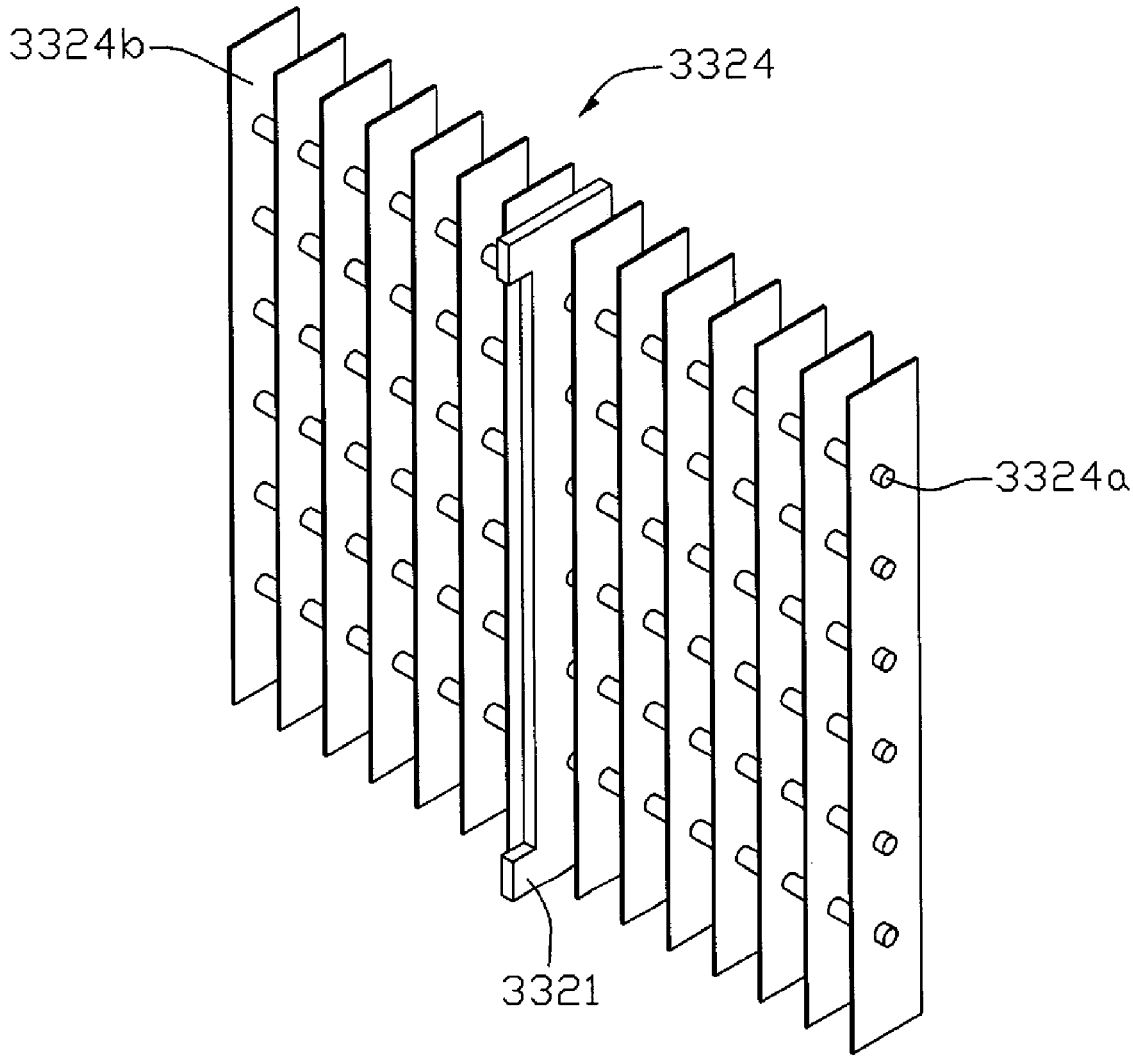
FIG. 6 is an isometric view of a sensible heat exchanger of the rotary total heat exchange apparatus shown in FIGS. 4 and 5.
Figure 7:
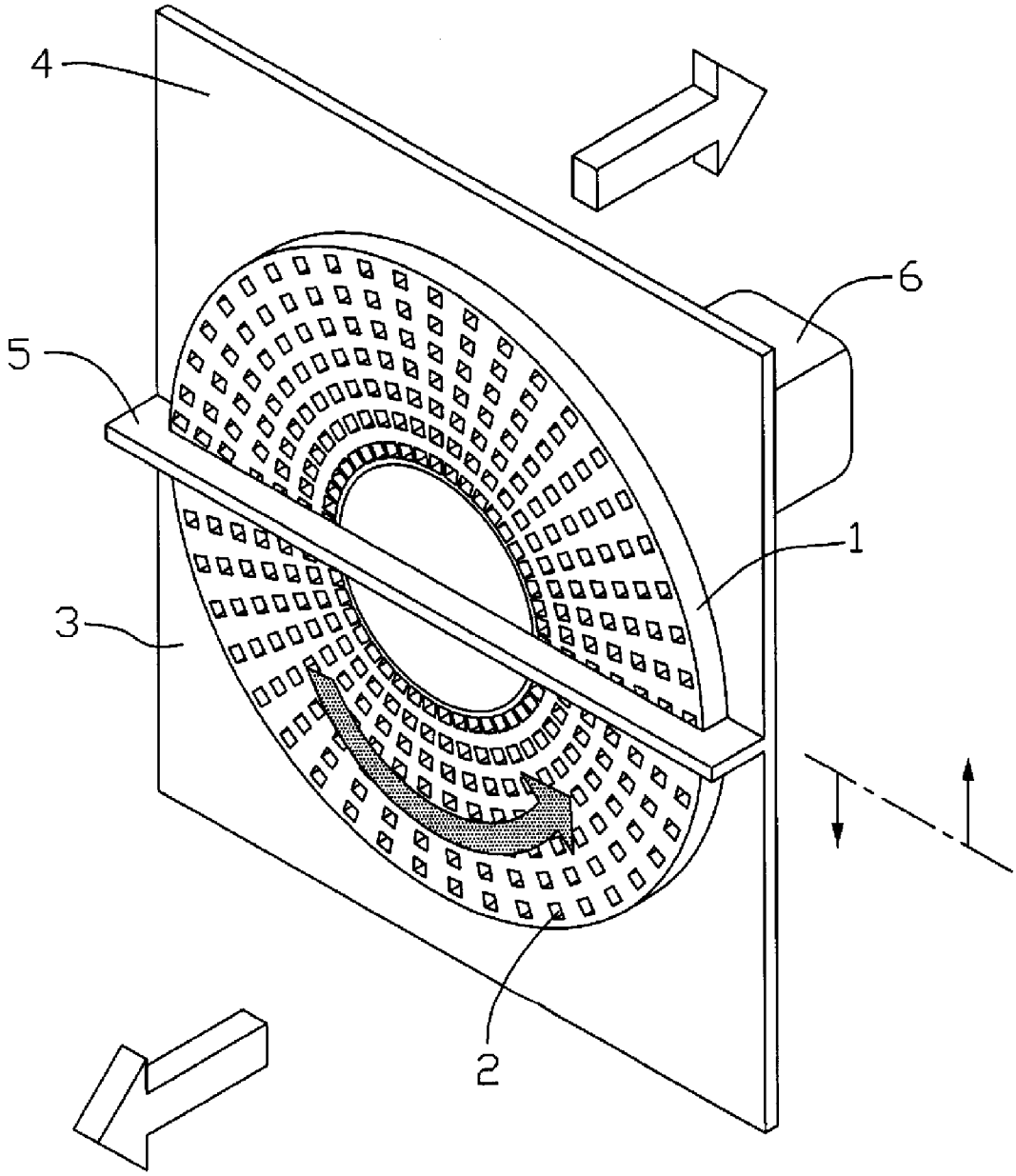
FIG. 7 (RELATED ART)
FIG. 7 is an isometric view of a rotary wheel for total heat exchange in accordance with related art.

Referring to FIGS. 4 and 5, the heat exchange apparatus 30 may further include a mesh-like air-regulating member 3323 received in the first housing 332 and vertically spanning across the dividing member 3321. Also, a sensible heat exchanger 3324 parallels to the air-regulating member 3323 located between the air-regulating member 3323 and the rotary wheel 3311. The air-regulating member 3323 defines a network of openings 3323*a* therein for airflow passages, therefore dividing the passing indoor and outdoor airflows into many smaller airflows. This further makes the indoor and outdoor airflows more evenly distributed over the mini channels 2 of the rotary wheel 3311. According to FIGS. 5 and 6, the sensible heat exchanger 3324 includes a plurality of heat transfer elements such as heat pipes 3324*a*, and a plurality of spaced cooling fins 3324*b* attached to the heat pipes 3324*a*. Each heat pipe 3324*a* has a heat-absorbing portion at one end thereof, and a heat-dissipating portion at the other end thereof. In this embodiment, the heat-absorbing portion is formed at the end of the heat pipe 3324*a* through which the outdoor airflow flows, and the heat-dissipating portion is formed at the end through which the indoor airflow flows. The middle portions of the heat pipes 3324*a* are hermetically connected with the dividing member 3321, for spanning across the left and right housings of the first housing 332. The fins 3324*b* are used to increase contacting areas between the airflows and the heat pipes 3324*a* so that when the airflows flow through the sensible heat exchanger 3324, sensible heat can be sufficiently transferred from one end portion of the heat pipes 3324*a* to the other end portion thereof. The sensible heat exchanger 3324 is located adjacent to the rotary wheel 3311, to conduct sensible heat exchange between the simultaneously passing airflows with different temperatures, thereby improving the total heat exchange efficiency of the heat exchange apparatus 30. On the other hand, the spaced cooling fins 3324*b* of the sensible heat exchanger 3324 can further divide the supplied air and the exhausted air into many small flows and guide them through the rotary wheel 3311. As a result, the supplied air and the exhausted air are more evenly distributed over the mini channels 2 of the rotary wheel 3311. Thus, a better total heat exchange between the supplied air and the exhausted air is obtained by the rotary wheel 3311.

Preferably, the cover 32 of the heat exchange apparatus 30 contains dust filters (not shown) respectively at the air inlet openings 321, 322 and the air outlet openings 323, 324 thereof, for preventing the mini channels 2 of the rotary wheel 3311 from being blocked by the dust taken by the airflows, thereby further improving the quality of the indoor air.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotary total heat exchange apparatus comprising:

at least an air-providing member for providing a first airflow from outdoors and a second airflow from indoors into the rotary total heat exchange apparatus;

a first air passage and a second air passage isolating from each other for guiding the first and second airflows respectively passing therethrough; and a total heat exchange wheel facing to the first and second airflows provided by the air-providing member and rotating through the first and second air passages for conducting a total heat exchange between the first and second airflows, the first and second airflows flowing through the total heat exchange wheel along a same direction, after flowing through the total heat exchange wheel, the first and second airflows flowing into two regions, respectively, the two regions being hermetically separated from each other by an air spacing member including a pair of plates inclining in different directions;

wherein the air spacing member comprises a spacing plate from which the pair of plates extend toward the total heat exchange wheel; and wherein the air spacing member comprises another spacing plate connecting two adjacent sides of the pair of plates and dividing the total heat exchange wheel into two halves.

2. The rotary total heat exchange apparatus of claim 1, wherein the first and second airflows provided by the air-providing member is directly flown to the total heat exchange wheel.

3. The rotary total heat exchange apparatus of claim 1, further comprising a sensible heat exchanger spanning across the said first and second airflows for conducting a sensible heat exchange between the first and second airflows.

4. The rotary total heat exchange apparatus of claim 3, wherein the sensible heat exchanger comprises a plurality of heat transfer elements thermally contact with the first and second airflows, each of the heat transfer elements comprises a heat absorbing portion and a heat dissipating portion.

5. The rotary total heat exchange apparatus of claim 4, wherein the sensible heat exchanger further comprises a plurality of fins attached to the heat absorbing and the heat dissipating portions.

6. The rotary total heat exchange apparatus of claim 1, further comprising an air-regulating member for dividing first and second airflows into many smaller airflows to make the first and second airflows distributed over the wheel more evenly.

7. A rotary total heat exchange apparatus comprising:

an air-providing housing enclosing an air-providing member therein, for providing an outdoor airflow and an indoor airflow separated from the outdoor airflow; and a total heat exchange housing enclosing therein a total heat exchange wheel facing to the outdoor and indoor airflows, the total heat exchange wheel being capable of rotating through the outdoor and indoor airflows to conduct a total heat exchange therebetween;

wherein the total heat exchange housing is divided into a first housing and a second housing via a partition plate;

wherein the second housing comprises an air spacing plate for guiding the outdoor airflow supplied into indoors, and the indoor airflow exhausted to outdoors; and wherein the air spacing plate comprises a first spacing plate, two second spacing plates extending slantingly and upwardly/downwardly from the first spacing plate, and a third spacing plate connected with neighboring sides of the second spacing plates.

8. The rotary total heat exchange apparatus of claim 7, wherein the outdoor and indoor airflows are guided to the total heat exchange housing via two air-guiding ducts.

9. The rotary total heat exchange apparatus of claim 8, wherein the total heat exchange wheel directly faces to outlets of the air-guiding ducts.

10. The rotary total heat exchange apparatus of claim 7, wherein the first housing comprises an air-regulating member for dividing air therethrough into many smaller airflows to make the outdoor and indoor airflows distributed over the wheel more evenly.

11. A rotary total heat exchange apparatus comprising:

a housing;

a rotary wheel capable of conducting total heat exchange between two airflows, wherein the rotary wheel is rotatably mounted in a partition plate mounted in the housing, said plate dividing an inner space of the housing into first and second regions;

an air spacing member mounted in the second region, the air spacing plate having a first spacing plate connected to the housing, a pair of second spacing plates extending from a side of the first spacing plate to respectively connect with top and bottom edges of the partition plate, and a third spacing space plate interconnected between adjacent sides of the second spacing plates and the partition plate and dividing the rotary wheel into first and second halves, the air spacing member dividing the second region into first and second sub-regions; and an indoor airflow flowing from the first region through the first half of the rotary wheel to enter the first sub-region and an outdoor airflow flowing from the first region through the second half of the rotary wheel to enter the second sub-region.

12. The rotary total heat exchange apparatus of claim 11, wherein a sensible heat exchanger is mounted in the first region, the indoor and outdoor airflows flow through the rotary wheel after flowing through the sensible heat exchanger to conduct a sensible heat exchange therebetween.

13. The rotary total heat exchange apparatus of claim 12, wherein the sensible heat exchanger includes at least a heat pipe and a plurality of fins attached to the at least a heat pipe.

14. The rotary total heat exchange apparatus of claim 13, wherein an air regulator including a mesh is mounted in the first region, the indoor and outdoor airflows flow through the sensible heat exchanger after flowing through the mesh of the air regulator.

15. The rotary total heat exchange apparatus of claim 11, wherein a blower is mounted in the first region, the blower drives the indoor and outdoor airflows flowing through the rotary wheel into the first and second sub-regions.

* * * * *